United States Patent [19]

DeStefano, Jr.

[11] Patent Number: 4,858,925

[45] Date of Patent: Aug. 22, 1989

[54] GOLF CLUB COMBINED WITH BALL POSITION MARKER

[76] Inventor: Peter DeStefano, Jr., 545 Main St., Follansbee, W. Va. 26037

[21] Appl. No.: 8,379

[22] Filed: Jan. 29, 1987

[51] Int. Cl.[4] ..... A63B 53/00

[52] U.S. Cl. ..... 273/162 D; 40/317

[58] Field of Search ..... 273/32 A, 162 D, 162 R, 273/162 A, 162 B, 162 C, 162 E, 162 F, 32 R, 32 D, 32 H, 186 R, 186 A, 183 D, 81 R, 81 A, 81 D; 40/317

[56] References Cited

U.S. PATENT DOCUMENTS 1,830,936 11/1931 Faith ..... 273/162 D
2,261,959 11/1941 Buttikofer ..... 273/32 A
3,556,364 1/1971 Maretka ..... 273/32 A
4,380,337 4/1983 Di Matteo ..... 273/162 D

FOREIGN PATENT DOCUMENTS 2049438 12/1980 United Kingdom ..... 273/32 A

*Primary Examiner*—George J. Marlo
*Attorney, Agent, or Firm*—H. Jay Spiegel & Associates

[57] ABSTRACT

A golf ball position marker (10) is detachably connected to a golf club including a resilient hand grip (20) containing an opening (25) located in a convex end surface (23) thereof. The opening (25) is adapted to stretch when an enlarged protruberance (19) at the end of the stem (17) passes therethrough. The marker (10) includes a head (11) having a convex upper surface and a concave undersurface. The convex end surface (23) of the grip (20) is complementary to the marker's concave undersurface.

2 Claims, 1 Drawing Sheet

Fig. 1
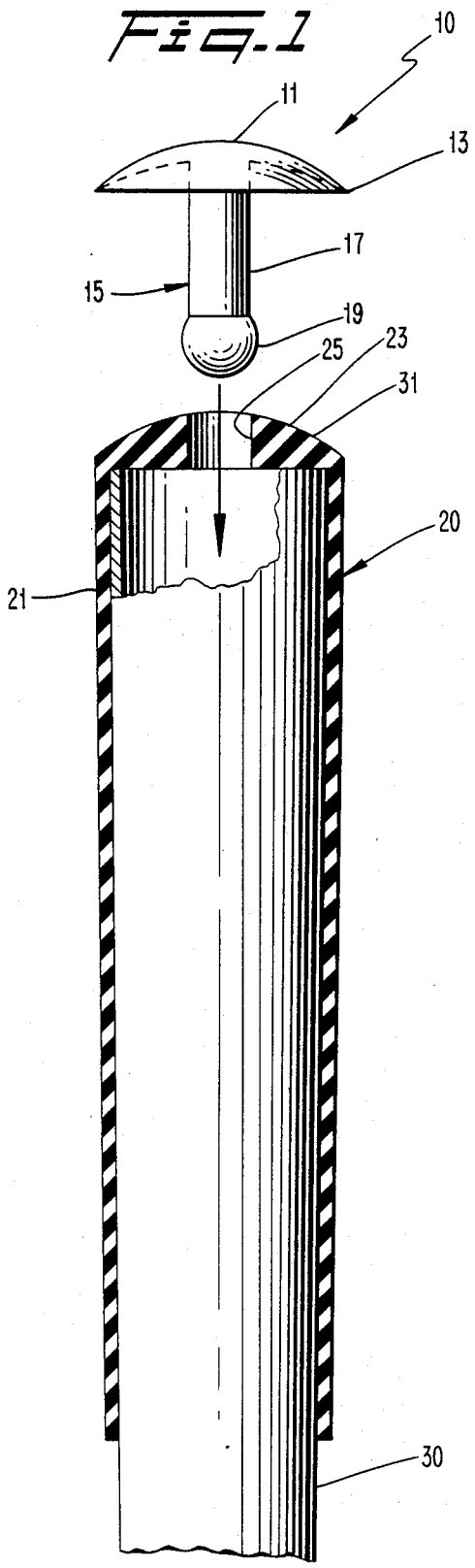
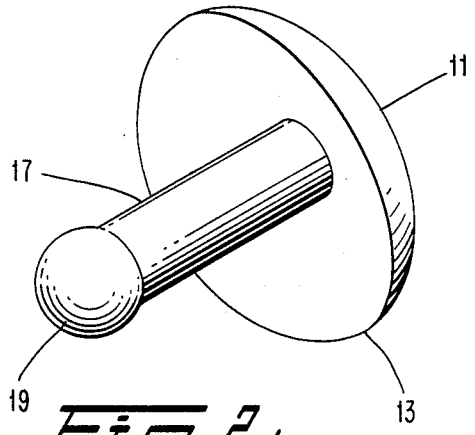
Fig. 2
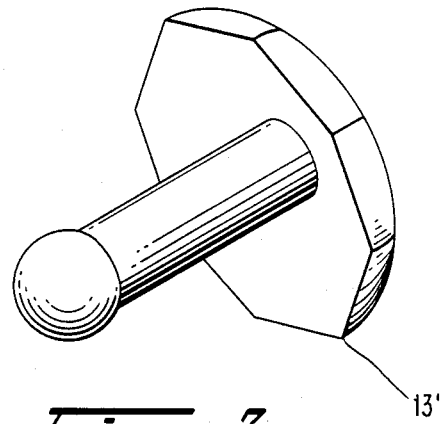
Fig. 3

GOLF CLUB COMBINED WITH BALL POSITION MARKER

BACKGROUND OF THE INVENTION

In the prior art, golf ball markers are well known and every golfer utilizes such a device so as to enable the golfer to mark the spot where the ball has been hit when the ball is lifted up for cleaning, green maintenance and other purposes. One problem with ball markers which are known before the advent of the present invention is the fact that ballmarkers are easy to lose since they may fall through a hole in the pocket of the golfer's pants, or may be accidentally dropped when carried in a shirt pocket. Thus, a need has developed for a simple and inexpensive golf ball marker which may be carried in such a manner that it is less likely to be lost.

The following prior art is known to applicant:

U.S. Pat. No. 3,774,913 to Dien discloses a combination green fixing tool and ball marker which is designed to be mounted in the handle of a club. The green fixing tool 16 has a female snap element 28 centrally mounted thereon which is adapted to receive a male protuberance 26 on a stem depending from the ball marker 14. The present invention is different from the teachings of Dien since Dien clearly shows the ball marker being attached to a green fixing tool whereas in the present invention the ball marker is directly attached to a grommet mounted on the golf club end. Furthermore, Dien fails to teach a ball marker having a domed configuration which is clearly more visible when placed in the ground. Accordingly, the present invention is believed to be distinct from the teachings of Dien.

U.S. Pat. No. 4,239,216 to Bauer discloses a device designated by the reference numeral 10 which may be placed into the top end of a golf club and which may dispense ball markers therefrom. Of course, the present invention is distinct from the teachings of this patent since in the present invention each ball marker includes a dome-shaped head portion and a depending stem with an enlarged protuberance. In Bauer, the device is mounted in the top of the club handle, however, the ball markers thereof do not have the structure necessary to be mounted in the top end of the club handle in the manner contemplated in the present invention.

SUMMARY OF THE INVENTION

The present invention overcomes the deficiencies found in the prior art and provides a new, improved golf ball marker of simplified design which has increased effectiveness and is less likely to be lost. The present invention includes the following interrelated features:

(a) Firstly, the inventive golf ball marker includes a dome-shaped head portion having a sharp peripheral edge enabling it to dig into the ground so as to be maintained in a fixed position. The periphery of the dome-shaped head is preferably substantially circular, however, this peripery may be made of any desired shape such as, for example, octagonal, square, etc.

(b) Depending from the underside of the dome-shaped head is a stem member which is elongated and has an enlarged protuberance on its end distal from the dome-shaped head.

(c) Included in the present invention is a grommet or other device which is designed to be inserted into the end of a golf club handle remote from the club head thereof. This grommet has an opening which is sized to frictionally receive the protuberance of the elongated stem of the ball marker so that the ball marker may be fixedly attached to the grommet by pushing the protuberance past the opening in the grommet so that the ball marker is retained thereon.

(d) Alternatively, instead of the grommet, many golf club handles as now manufactured include a cap or other device on the end of the club handle opposite to the club head which cap or other device has an opening therethrough. In such an event, the enlarged protuberance is designed of a size so that it may be inserted through the opening through the application of a predetermined force.

Accordingly, it is a first object of the present invention to provide an improved golf ball marker.

It is a further object of the present invention to provide such a ball marker including a dome-shaped head for better visibility when the marker is placed in the ground.

It is a still further object of the present invention to provide such a ball marker with an elongated stem having an enlarged protuberance thereon so that the marker may be removably attached to the handle of a golf club so that it will not be lost.

These and other objects, aspects and features of the present invention will be better understood from the following detailed description of the preferred embodiments when read in conjunction with the appended drawing figures.

BRIEF DESCRIPTION OF THE DRAWINGS

FIG. 1 shows a cross-sectional view through the ball marker and grommet of the present invention as well as through an associated handle of a golf club.

FIG. 2 shows a perspective view of a first embodiment of a golf ball marker in accordance with the present invention.

FIG. 3 shows a perspective view of a second embodiment of a golf ball marker in accordance with the present invention.

SPECIFIC DESCRIPTION OF THE PREFERRED EMBODIMENTS

With reference to FIG. 1, it is seen that the inventive ball marker 10 includes a dome-shaped head 11 with a peripheral edge 13, 13' around the periphery thereof, and a concave underside designed to overlie the ground when the marker is placed in the ground so as to aid in retaining the ball marker in place.

The ball marker 10 further includes a stem 15 including an elongated portion 17 and a protuberance 19 which is enlarged with respect to the thickness of the elongated portion.

With further reference to FIG. 1, the handle 30 of a golf club is seen to include an open end 31 over which is installed a resilient grip 20 having a cylindrical portion 21, a disk-shaped portion 23 at the end of the cylindrical portion 21 and an opening 25 through the disk-shaped portion 23. The disk-shaped portion 23 overlies the end 31 of the handle 30 so as to limit the distance to which the grip 20 may be slid over the handle 30, and has a convex surface complementary to the concave underside of the head 11.

The opening 25 in the grip 20 is specifically sized so as to be slightly smaller in diameter than the diameter of the enlarged protuberance 19. Since the grip 20 is made of a resilient material such as, for example, rubber, when the enlarged protuberance 19 is pushed into the opening 25, the opening 25 will slightly stretch so as to enable the protuberance 19 to pass therethrough whereupon the elongated portion 17 of the stem 15 may then be inserted through the opening 25 to thereby retain the ball marker 10 within the grip 20 by virtue of the frictional forces which are necessary in order to remove the enlarged protuberance 19 back through the opening 25.

With reference to FIG. 2, it is seen that the periphery 13 of the dome-shaped head 11 of the ball marker 10 may have a substantially circular configuration. Alternatively, any other desired configuration for the shape of the periphery of the head 10 may be used. For example, FIG. 3 shows a periphery 13' of octagonal configuration. Of course, the periphery 13 may be made, for example, oval, square, diamond shaped or any other desired configuration and shape.

In the preferred embodiment, the ball marker may be made of any rigid material such as for example plastic or metal and may, if desired, be made of precious metals such as gold, silver or platinum. Any plastic material may be used in manufacturing the present invention only limited by the expense and ease of molding.

Accordingly, an invention has been disclosed in terms of the preferred embodiments thereof which overcomes the deficiencies found in the prior art and which provides an improved golf ball marker which is simplified over the teachings of the prior art, just as effective as prior art ball markers and includes structure to interface with the handle of a golf club so as to reduce the incidence of loss of golf ball markers. Of course, various modifications, changes and alterations in the teachings of the present invention may be contemplated by those skilled in the art without departing from the intended spirit and scope thereof. Accordingly, it is intended that the present invention only be limited by the terms of the appended claims.

I claim:

1. In a golf club having a handle with a resilient grip placed over its proximal end, said grip being elongated and having a proximal end with a convex surface and an opening extending through said proximal end, the improvement comprising a golf ball marker including:

(a) a head including a convex upper surface connected to a concave undersurface engageable with said convex surface of said grip proximal end in complimentary fashion;

(b) a stem having a proximal end and a distal end, said stem merging into said concave undersurface at its proximal end and having an enlarged protuberance on its distal end;

(c) said stem and protuberance being insertable through said opening to install said marker on said grip with said concave undersurface engageable on said grip proximal end convex surface, the outer diameter of said protuberance being greater than the diameter of said opening whereby the resiliency of said grip allows said protuberance to be forced through said opening whereupon the resiliency of said grip aids in maintaining said golf ball marker in mounted position on said grip.

2. The invention of claim 1, wherein said proturbance is substantially spherical.

* * * * *